US006766881B2

(12) United States Patent
Carty

(10) Patent No.: US 6,766,881 B2
(45) Date of Patent: Jul. 27, 2004

(54) LADDER-MOUNTED TOOL HOLDER

(75) Inventor: John E. Carty, Fort Lauderdale, FL (US)

(73) Assignee: Anderson A. Medina, Sr., Fort Lauderdale, FL (US); part interest ( * ) Notice: Subject to any disclaimer, the term of this patent is extended or adjusted under 35 U.S.C. 154(b) by 0 days.

(21) Appl. No.: 10/208,318

(22) Filed: Jul. 31, 2002

(65) Prior Publication Data

US 2004/0020716 A1 Feb. 5, 2004

(51) Int. Cl.[7] ..... E04G 1/00; E06C 7/14; B65D 85/28

(52) U.S. Cl. ..... 182/129; 248/210; 206/373

(58) Field of Search ..... 182/129; 248/210, 248/238, 211; 220/570, 576, 523; D25/68; 206/372, 373

(56) References Cited

U.S. PATENT DOCUMENTS

| | | | | |
|---|---|---|---|---|
| 4,356,854 A | | 11/1982 | McGee | |
| 4,773,535 A | | 9/1988 | Cook | |
| D317,206 S | | 5/1991 | Cagle | |
| D380,276 S | | 6/1997 | Gaona et al. | |
| 5,638,915 A | | 6/1997 | Hardy | |
| 5,647,453 A | | 7/1997 | Cassells | |
| 5,749,437 A | | 5/1998 | Weller | |
| 5,813,530 A | | 9/1998 | Kornblatt | |
| D410,551 S | | 6/1999 | Guimont et al. | |
| 5,988,383 A | | 11/1999 | Armstrong | |
| 6,334,509 B1 | * | 1/2002 | Ryszkiewicz | 182/129 |
| 6,435,389 B1 | * | 8/2002 | Sucher | 182/129 |
| 6,564,941 B2 | * | 5/2003 | Hedges | 206/373 |

* cited by examiner

*Primary Examiner*—Hugh B. Thompson, II
(74) *Attorney, Agent, or Firm*—Oltman, Flynn & Kubler

(57) ABSTRACT

A tool holder for mounting on the top of a conventional stepladder. The holder has trapezoidal pocketed end panels and a rectangular pocketed back panel each flexibly connected to a top panel that can be strapped to the top piece of the ladder. The end and back panels conform closely to the outlines of corresponding sides of the ladder at its upper end and are attachable to each other at adjoining side edges to fit snugly around the ladder. A pocketed front panel is manually attachable to and detachable from the top panel.

8 Claims, 5 Drawing Sheets

LADDER-MOUNTED TOOL HOLDER

BACKGROUND OF THE INVENTION

1. Field of the Invention

This invention relates to a holder for tools, fasteners and supplies that is intended to be mounted on the top of a conventional folding stepladder having a four-legged, top-hinged frame.

2. Prior Art

Various stepladder-mounted pocketed holders for tools, fasteners and the like have been proposed heretofore for the convenience of a person standing on the ladder.

For example, U.S. Pat. No. 4,356,854 to McGee discloses a pocketed holder for tools and supplies that is shaped to fit snugly over the top of a conventional folding stepladder. Other shaped tool holders of the same general type are disclosed in Weller U.S. Pat. No. 5,749,437, Kornblatt U.S. Pat. No. 5,813,530, and Armstrong U.S. Pat. No. 5,988,383.

Cook U.S. Pat. No. 4,773,535 (FIG. 3) discloses an open-bottomed, non-folding, vertical sided, box-like tool holder that seats on top of a folding stepladder.

Hardy U.S. Pat. No. 5,638,915 discloses a foldable tool holder with a rectangular central top panel that rests on top of a stepladder and four pocketed rectangular side panels or "skirtings" that hang down from the respective edges of the top panel and are attached to it by various means, including sewn stitching, a zipper, buttonable or clippable straps, and rivets. Straps are provided on the lower ends of the side panels or skirtings for tying them to the ladder's support rails.

Cassells U.S. Pat. No. 5,647,453 discloses a foldable tool holder with a rectangular, central top panel that fits on top of a stepladder and four pocketed trapezoidal side panels that hang down from the respective edges of the top panel. The side panels are attachable to each other at their lower ends by hook and loop tapes on straps that respectively wrap around the legs, one front step and one back rung of the ladder.

SUMMARY OF THE INVENTION

The present invention is directed to a novel tool holder for snug, substantially form-fitting attachment to the top of a conventional stepladder to make tools, fasteners, supplies and the like readily accessible to a person standing on the ladder.

A principal object of this invention is to provide a novel and advantageous stepladder-mounted tool holder that can be readily applied to the top of the ladder with a snug fit that keeps it securely in place on the ladder.

Another object of this invention is to provide such a tool holder having a manually attachable and detachable front panel that enables the remainder of the tool holder to be positioned on the ladder before the front panel is attached, and when detached enables the ladder user to stand on upper steps of the ladder without interference from the tool holder.

Further objects and advantages of this invention will be apparent from the following detailed description of a presently preferred embodiment thereof, with reference to the accompanying drawings.

DETAILED DESCRIPTION OF THE INVENTION

Before explaining the present invention in detail it is to be understood that the invention is not limited in its application to the particular arrangement shown and described since the invention is capable of other embodiments. Also, the terminology used herein is for the purpose of description and not of limitation.

Figure 1:
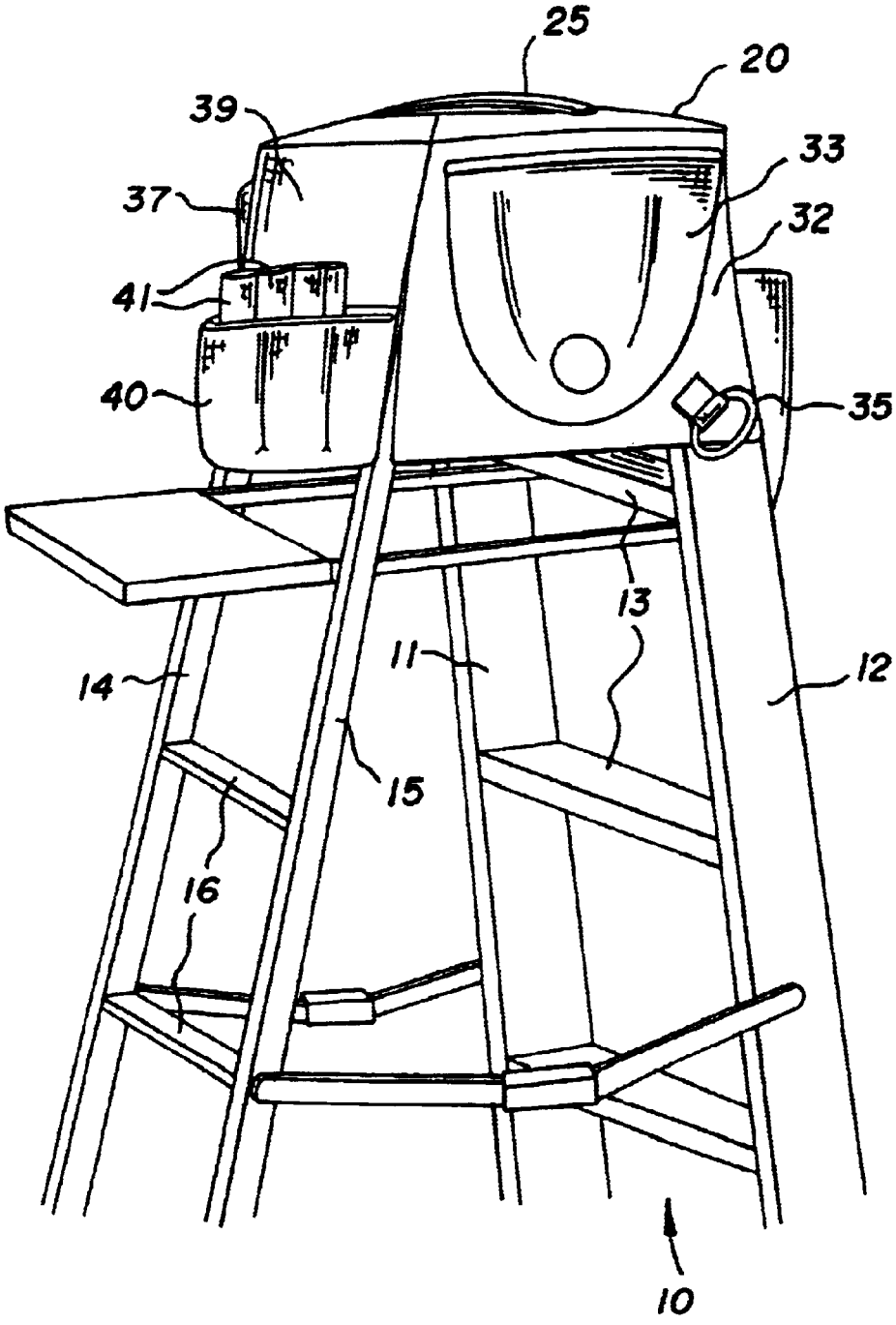
FIG. 1 is a perspective view taken from the rear side of a folding stepladder with the present tool holder in place thereon.

The present tool holder is for use with a conventional top-hinged, four-legged stepladder 10 as shown in FIG. 1. When erected, the ladder's front legs 11 and 12 extend down from a flat rectangular top piece T (FIG. 6) near its opposite ends and carry steps 13 at different levels below the top piece. The ladder's back legs 14 and 15 extend down from the top piece T near its opposite ends and they carry cross pieces 16 at different levels. When erected, viewed from the front or back the stepladder has a rectangular outline, and viewed from either end it has a trapezoidal outline.

Figure 2:
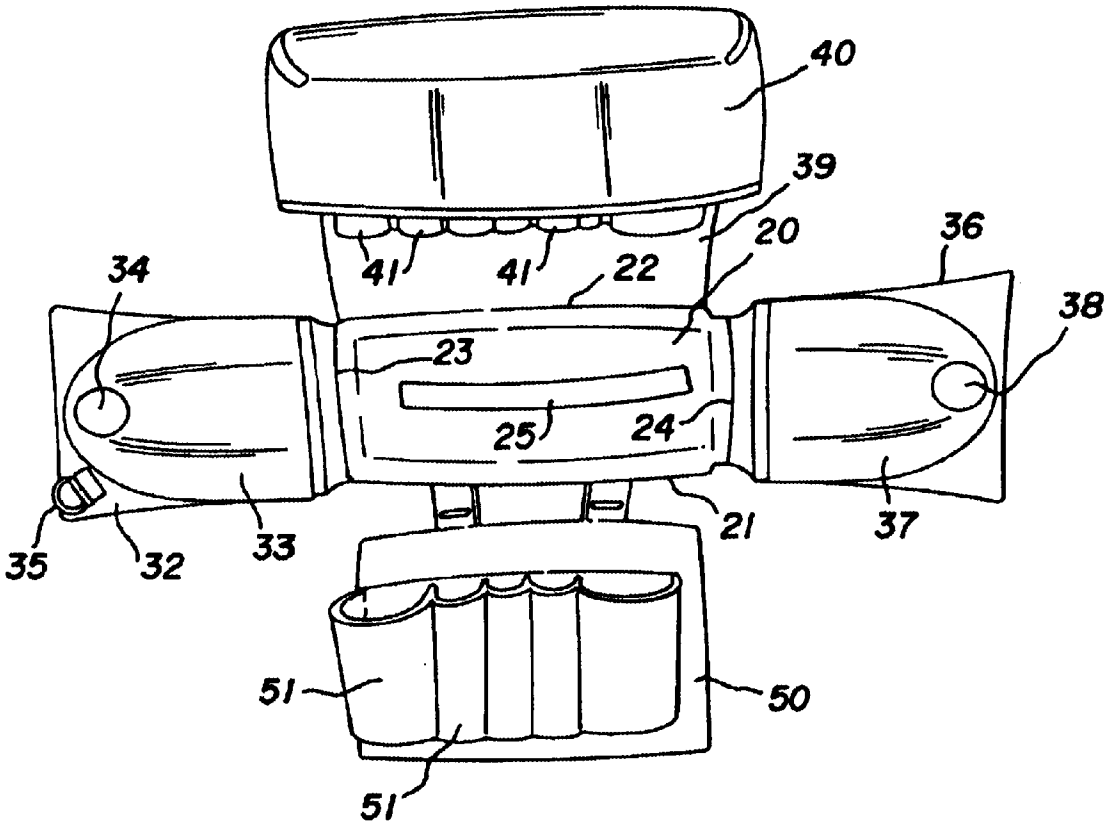
FIG. 2 is a top plan view of the present tool holder unfolded.
Figure 3:
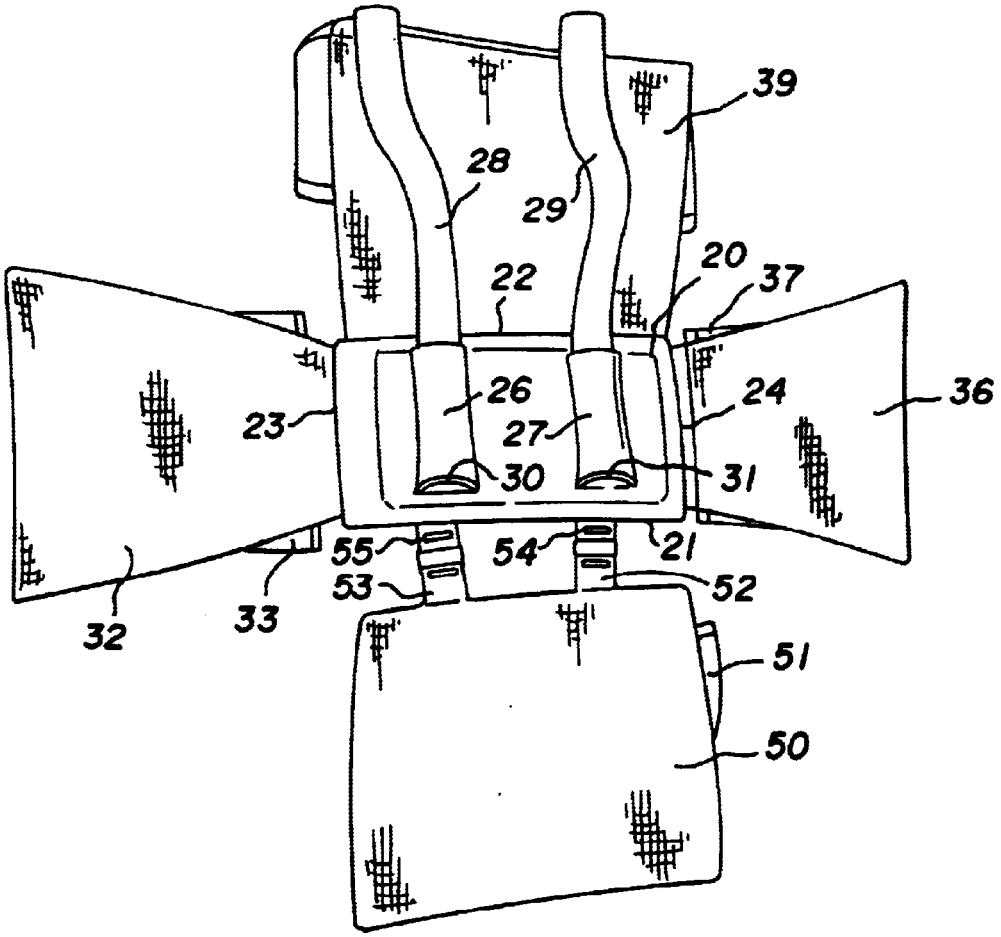
FIG. 3 is a bottom plan view of this tool holder unfolded.

As shown in FIGS. 2 and 3, the present tool holder has a central top panel 20 of rectangular configuration that substantially matches that of the top piece T of the ladder, presenting a substantially straight front edge 21 that overlies the front edge of the ladder top piece, a substantially straight back edge 22 that overlies the back edge of the ladder top piece, and substantially straight opposite end edges 23 and 24 that overlie corresponding end edges of the ladder top piece.

The top panel 20 of this tool holder preferably is constructed with a foam layer sandwiched between top and bottom sheets of leather or leather-like material. A flexible carrying handle 25 (FIGS. 1, 2 and 4) of suitable fabric has its opposite ends affixed to the top of panel 20 and extends parallel to the front and back edges 21 and 22 of panel 20 midway between them.

Figure 6:
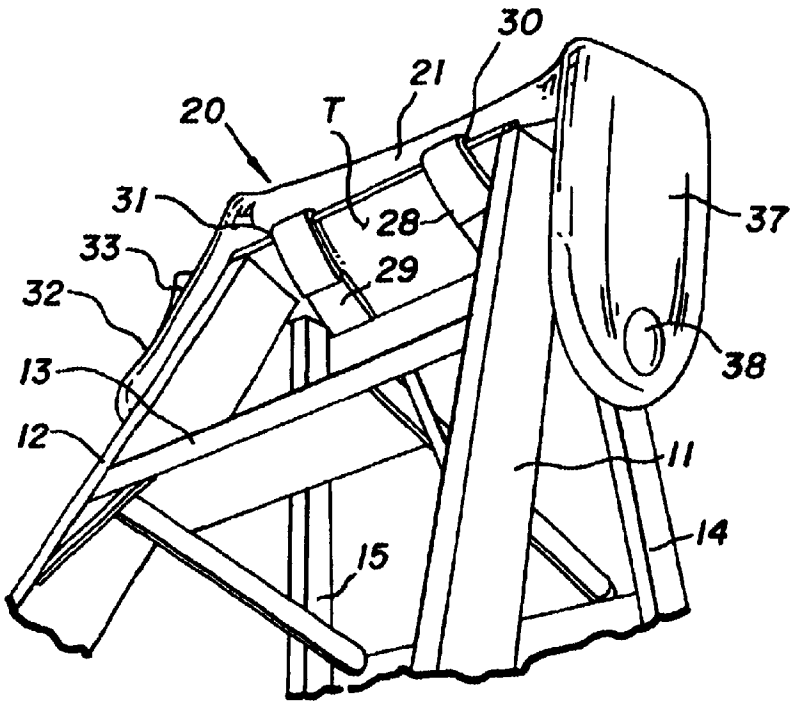
FIG. 6 is a perspective view looking up at the front side of the stepladder with the present tool holder in place but with its front panel removed.
Figure 5:
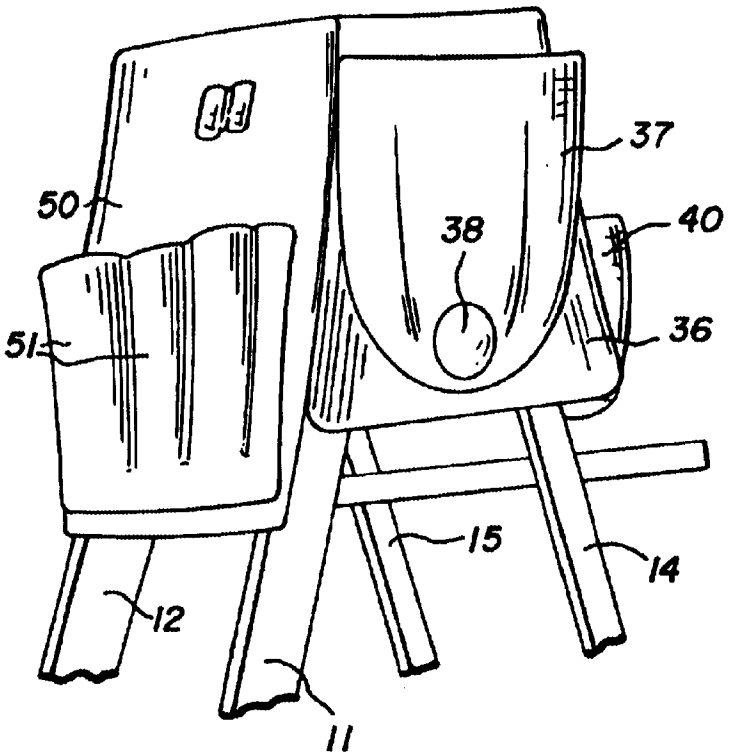
FIG. 5 is a front perspective view of this tool holder in place on the top of a stepladder.

On the bottom (FIG. 3), the top panel 20 carries a pair of pads 26 and 27, each of which is elongated perpendicular to the front and back edges 21 and 22. Elongated straps 28 and 29 of suitable fabric are each affixed at one end to the bottom of panel 20 near its back edge 22. Metal D-rings 30 and 31 are pivotally mounted on the bottom of panel 20 near its front edge 21. The free ends of straps 28 and 29 can be passed through these D-rings and folded over on themselves (FIG. 6). Complementary hook or loop fastener strips of Velcro® are provided on the confronting faces of the straps where they are folded over so that they can be manually attached to and separated from each other. In use, each strap 28 or 29 is passed under the top piece T of the ladder and through the respective D-ring 30 or 31 and pulled tight before the hook and loop fastener strips are brought into interlocking engagement with each other to hold the top panel 20 of the tool firmly in place on the top piece T of the ladder.

A left panel 32 of this tool holder of suitable material is joined to the top panel 20 along its left edge 23, such as by sewn stitching, and hangs down from it to the left of the ladder when the tool holder is in place on the ladder, as shown in FIG. 1. Panel 32 has a trapezoidal shape (narrower at the top) substantially matching the trapezoidal outline of the left end of the ladder in its erected state. On the outside, the left panel carries a large pouch 33 that provides a plurality of open-topped pockets for receiving and holding various tools, screws, nails, and other supplies. A tool holder loop 34 also is affixed to the outside of pouch 33 near its lower end. A metal D-ring 35 is pivotally affixed to the left panel 32 near its bottom edge.

A similar trapezoidal right panel 36 of the tool holder is joined in the same manner to its top panel 20 along its right edge 24. On the outside, panel 36 carries a pouch 37 providing several open-topped pockets for holding different tools, fasteners, or other supplies. A tool holder loop 38 is affixed to the outside of pouch 37 near its lower end.

The tool holder of this invention has a back panel 39 of rectangular shape substantially matching the rectangular configuration of the back side of the ladder. Panel 39 carries a compartmentalized pouch 40 extending across substantially its full width up from its lower edge and providing three large open-topped pockets 40. Inside these large pockets are a plurality of open-topped inner pockets 41 of smaller cross-sectional size for holding individual tools, such as screw drivers. The back panel 39 is joined to the top panel 20 along the latter's back edge 22 in the same manner as the left and right panels 32 and 36 are joined to top panel 20.

The material of each end panel 32 and 36 and the back panel 39 is sufficiently flexible that this panel hangs down from the top panel 20 next to the corresponding side of the ladder when the tool holder is in place on the ladder. Panels 32, 39 and 36 carry hook and loop fastener strips along their neighboring downwardly extending edges so that they may be wrapped snugly against the ladder.

As thus far described, the present tool holder has a top panel, a back panel, and opposite end panels. As thus constituted, it may be readily applied to the upper end of the step ladder, with the top panel 20 strapped to the top piece T of the ladder, and the back panels 39, the left panel 32 and the right panel 36 extending down next to the corresponding sides of the ladder, leaving the front side of the ladder (where its steps 13 are located) open from the top down. For certain jobs the user may choose to leave the tool holder this way on the ladder so that he or she can stand on upper steps of the ladder without interference from the tool holder.

Figure 4:
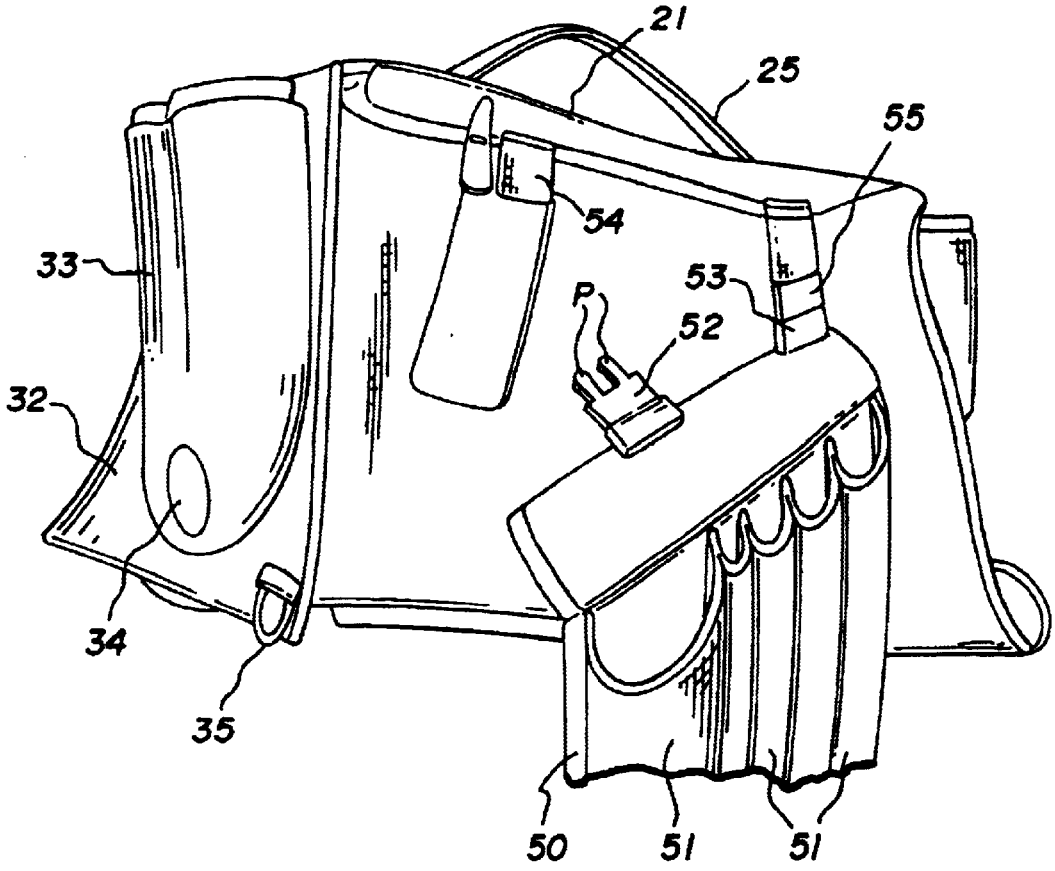
FIG. 4 is a front perspective view of this tool holder with its front (step side) panel partly attached.

However, in most situations the user will attach a front panel of the tool holder to its top panel 20 so as to provide additional storage capacity at the front for tools and supplies. This front panel of the present tool holder is shown at 50 in FIGS. 2, 3, 4 and 5. It carries a plurality of open-topped pockets 51 extending side-by-side up from the lower edge of the panel. At the top the front panel 50 carries a pair of laterally spaced latch plates 52 and 53, each with two projecting prongs P (FIG. 4). A pair of buckles 54 and 55 extend from the front of top panel 20 for slide-in reception and locking engagement therein of the respective latch plates 52 and 53, which snap into locking engagement with the buckles in essentially the same manner as a passenger car seat belt. Each buckle 54 and 55 preferably has a push-button release enabling the separation of the corresponding latch plate from locking engagement with the buckle when the user decides to detach the front panel 50 from the rest of the tool holder. Preferably, the front panel 50 has hook or loop fastener strips along the sides for manually attachable and detachable interlocking engagement with complementary loop or hook fastener strips on the adjacent sides of the neighboring end panels so that the complete tool holder (including the front panel 50) has a snug fit on the upper part of the stepladder.

From the foregoing, it will be evident that the illustrated embodiment of this invention can be conveniently and readily applied with substantially form-fitting engagement to the top of the stepladder absent the front panel, which may be attached afterward or left off depending on the user's preference.

I claim:

1. A tool holder for mounting on top of a top-hinged, four-legged stepladder having a substantially rectangular flat top piece, a pair of front legs extending down from said top piece at opposite ends thereof at a front side of the stepladder, a pair of back legs extending down from said top piece at opposite ends thereof at a back side of the stepladder, a plurality of steps extending between said front legs at different levels below said top piece on the front side of the stepladder, and a plurality of cross pieces extending between said back legs at different levels below said top piece on the back side of the stepladder, said tool holder comprising:

a substantially rectangular flat top panel shaped and dimensioned to overlie said top piece of the stepladder and having a front edge positioned to extend across said top piece of the stepladder at said front side thereof and a back edge positioned to extend across said top piece of the stepladder at said back side thereof, a substantially rectangular back panel with pockets thereon flexibly joined to said top panel across said back edge thereof and shaped and dimensioned to hang down from said top panel across said back side of the stepladder;

a pair of trapezoidal opposite end panels with pockets thereon flexibly joined to said top panel at opposite ends thereof between said back and front edges of the top panel and each shaped and dimensioned to hang down from said top panel across said stepladder between said back and front sides thereof;

a substantially rectangular front panel with pockets thereon shaped and dimensioned to hang down from said top panel across said front side of the stepladder, and manually engageable and releasable connector members on said top panel at its front edge and on said front panel for releasably attaching said front panel to said top panel and permitting removal of said front panel from the holder to enable a person to stand on an upper step of the stepladder normally covered by said front panel when attached to said top panel;

and manually engageable and releasable fastener elements on said back panel, said end panels and said front panel for interconnecting them to fit snugly around the stepladder down from said top piece thereof.

2. The tool holder according to claim 1, wherein said connector members are buckles and latch plates slidably insertable into said buckles for locking engagement therewith, each of said buckles having a manually operable release for the corresponding latch plate.

3. The tool holder according to claim 2, wherein said fastener elements are interlocking hook and loop fabrics.

4. The tool holder according to claim 1, wherein said fastener elements are interlocking hook and loop fabrics.

5. A tool holder for mounting on top of a top-hinged, four-legged stepladder having a substantially rectangular flat top piece, a pair of front legs extending down from said top piece at opposite ends thereof at a front side of the stepladder, a pair of back legs extending down from said top piece at opposite ends thereof at a back side of the stepladder, a plurality of steps extending between said front legs at different levels below said top piece on the front side of the stepladder, and a plurality of cross pieces extending between said back legs at different levels below said top piece on the back side of the stepladder, said tool holder comprising:

a substantially rectangular flat top panel shaped and dimensioned to overlie said top piece of the stepladder and having a front edge positioned to extend across said top piece of the stepladder at said front side thereof and a back edge positioned to extend across said top piece of the stepladder at said back side thereof, a carrying handle attached to said top panel and extending across the top thereof substantially parallel to said front and back edges of the top panel, a pair of flexible straps each affixed at one end to the bottom of said top panel and extending away from said affixed end substantially perpendicular to said front and back edges of the top panel to lie beneath said top piece of the stepladder, and manually engageable and releasable fastener elements on confronting faces of said straps where they are folded over for holding said straps against the bottom of said top piece of the stepladder;

a substantially rectangular back panel with pockets thereon flexibly joined to said top panel across said back edge thereof and shaped and dimensioned to hang down from said top panel across said back side of the stepladder;

a pair of trapezoidal opposite end panels with pockets thereon flexibly joined to said top panel at opposite ends thereof between said back and front edges of the top panel and each shaped and dimensioned to hang down from said top panel across said stepladder between said back and front sides thereof;

a substantially rectangular front panel with pockets thereon shaped and dimensioned to hang down from said top panel across said front side of the stepladder, and manually engageable and releasable connector members on said top panel at its front edge and on the upper end of said front panel for releasably attaching said front panel to said top panel and permitting removal of said front panel from the holder to enable a person to stand on an upper step of the stepladder normally covered by said front panel when attached to said top panel;

and manually engageable and releasable fastener elements on said back panel, said end panels and said front panel for interconnecting them to fit snugly around the stepladder down from said top piece thereof.

6. The tool holder according to claim 5, wherein said connector members are buckles and latch plates slidably insertable into said buckles for locking engagement therewith, each of said buckles having a manually operable release for the corresponding latch plate.

7. The tool holder according to claim 6, wherein said fastener elements on said back panel, said end panels, said front panel, and said pair of flexible straps are interlocking hook and loop fabrics.

8. The tool holder according to claim 5, wherein said fastener elements on said back panel, said end panels, said front panel, and said pair of flexible straps are interlocking hook and loop fabrics.

* * * * *